US005092479A

United States Patent [19]

Wells

[11] Patent Number: 5,092,479

[45] Date of Patent: Mar. 3, 1992

[54] RIGID ONE-PIECE MERCHANDISING CONTAINER

[75] Inventor: Cindy M. Wells, Madison, Wis.

[73] Assignee: Oscar Mayer Foods Corporation, Madison, Wis.

[21] Appl. No.: 451,433

[22] Filed: Dec. 14, 1989

[51] Int. Cl.[5] ..... B65D 6/00

[52] U.S. Cl. ..... 220/4.23; 220/307; 220/326; 220/339; 229/2.5 R; 206/518; 206/519

[58] Field of Search ..... 220/4.21, 4.22, 4.23, 220/337, 339, 324, 326, 306, 307; 229/2.5 R, 2.5 EC; 206/518, 519

[56] References Cited

U.S. PATENT DOCUMENTS

| | | | |
|---|---|---|---|
| 3,144,973 | 8/1964 | Heintzelman . | |
| 3,276,656 | 10/1966 | Hartmann et al. | 229/2.5 EC |
| 3,372,852 | 3/1968 | Marcus | 229/2.5 EC |
| 3,459,360 | 8/1969 | Bagay . | |
| 3,536,251 | 10/1970 | Edwards . | |
| 3,558,057 | 1/1971 | Andrews . | |
| 3,767,110 | 10/1973 | Congleton . | |
| 3,851,789 | 12/1974 | Case et al. | 220/307 |
| 3,902,540 | 9/1975 | Commisso . | |
| 3,977,595 | 8/1976 | Hillgenberg . | |
| 3,985,289 | 10/1976 | Prince . | |
| 3,999,661 | 12/1976 | Jones . | |
| 4,057,169 | 11/1977 | Payne . | |
| 4,079,880 | 3/1978 | Edwards . | |
| 4,146,170 | 3/1979 | Mendendorp | 220/307 X |
| 4,183,446 | 1/1980 | Davis | 220/306 |
| 4,244,470 | 1/1981 | Burnham | 206/525 |
| 4,253,600 | 3/1981 | Schubert | 229/2.5 R |
| 4,383,638 | 5/1983 | Bixler . | |
| 4,570,818 | 2/1986 | Borst et al. . | |
| 4,602,719 | 10/1986 | Borst . | |
| 4,753,351 | 6/1988 | Guillin | 206/520 |
| 4,787,552 | 11/1988 | Natori | 229/2.5 R |
| 4,842,143 | 6/1989 | McKee et al. . | |
| 4,892,220 | 1/1990 | Foos | 220/339 |
| 4,901,884 | 2/1990 | Kallenbach | 220/339 |
| 4,915,251 | 4/1990 | Payne | 220/306 |
| 4,971,220 | 11/1990 | Kaufman et al. | 220/335 |
| 4,986,438 | 1/1991 | Borst | 220/315 |

FOREIGN PATENT DOCUMENTS

| | | | |
|---|---|---|---|
| 2589443 | 5/1987 | France | 229/2.5 EC |

*Primary Examiner*—Stephen Marcus
*Assistant Examiner*—Stephen Cronin
*Attorney, Agent, or Firm*—Lockwood, Alex, Fitzgibbon & Cummings

[57] ABSTRACT

A rigid one-piece merchandizing container made of synthetic plastic sheet is provided. The merchandising container is suitable for storing food products such as sandwich type products within warming ovens useful in self-serve food store operations. The merchandising container includes a sealing peripheral lip structure, an especially flexible hinge portion, and a locking assembly that ensures closure of the merchandising container until the locking assembly is precisely manipulated through an unlocking procedure.

18 Claims, 2 Drawing Sheets

RIGID ONE-PIECE MERCHANDISING CONTAINER

BACKGROUND AND DESCRIPTION OF THE INVENTION

The present invention generally relates to merchandising containers for food products which enable the food products to be stored at elevated temperatures for extended time periods without any significant deterioration of food quality. More particularly, the merchandising container is a one-piece hinged unit that is molded of so-called rigid synthetic plastic material that is sized and shaped to merchandise and store ready-to-eat food products in a manner by which the food products can be immediately consumed without assembly, heating or other handling procedures. The merchandising container includes a tray portion and a cover portion that exhibit a tight interference fit with each other. In addition, a locking assembly is included for keeping the container closed even while the merchandising container is lifted and transported when only the cover portion thereof is grasped by the customer.

Containers for merchandising food products including so-called fast-food items such as hamburger sandwiches, hot dog sandwiches and other sandwiches incorporating meats and/or cheeses within bread, a bun, or other dough-like food items, are generally well-known. Many of these merchandising containers are constructed of foamed polymers, paperboards, foils and the like which are usually non-transparent, making impossible to inspect the food item without handling and opening the merchandising container. In many fast-food types of operations, non-transparent packaging is acceptable, if not desirable, because employees of the fast-food store select the packaged item and deliver it to the customer without any opportunity for the customer to choose specific containerized food products. In addition, it is often the case that the identity of the fast-food product within the container is designated by wording and/or color coding which is easily discernible from viewing the outside of the merchandising container. In addition, the selection process in these types of fast-food operations often is further facilitated by providing numerous merchandising compartments, each being designated for a specific type of fast-food item.

In fast-food stores such as these wherein an employee of the store selects and transports the containerized food item from a temporary holding location to a bag or tray which is then presented to the customer, the store can rely upon the experience of its employee and the employee's familiarity with the merchandising containers in order to be certain that the containerized fast-food is delivered to the customer without mishap. In these types of merchandising operations, the experience and/or training of the employee will be important in generally ensuring that the containerized food product will remain within the merchandising container because the employee will be aware of the proper manner of handling the containerized food product without inadvertent opening of the merchandising container and possible spillage of the food product out of its container. Accordingly, in these types of operations, merchandising container locking means typically are not especially secure.

Other types of fast-food stores have a self-service aspect whereby the customer is the one who removes the containerized food product from a warming location, typically for transport to another location in the store at which the containerized ready-to-eat food product is purchased. In these types of operations, it is important that the container will not inadvertently open when it is handled in a less-than-desirable manner, such as by having the customer grasp the container by only its cover portion. In addition, in at least some of these types of self-service stores, the customer has the ability to select among several different containers, each of which contains the same type of food product, such as a hot dog in a bun, or the like. In these instances, a customer may have an inclination to inspect the containerized food products, such as opening the merchandising container in order to inspect for freshness, size, and the like. Such inspection is generally not desirable from at least a public health and safety point of view. It would therefore be desirable to provide transparent containers which permit inspection without opening the package and which provide a locking feature that requires conscious manipulation thereof in order to open the package so that it will not become inadvertently opened.

Another consideration for marketing ready-to-eat food products is to take steps in order to maintain the freshness and consistency of the food product within the container during the time that the containerized food product is stored in a heated state so that it is at a temperature preferred for consumption. Many prior art merchandising containers do not provide an adequate seal so as to maintain desired humidity conditions within the container, and/or components such as buns, breads and the like tend to stick to the portion of the container within which it is in contact, particularly after storage at consumption temperatures for substantial time periods.

In summary, the present invention is particularly well suited for self-serve retail outlets for ready-to-eat food products that may be stored at elevated consumption temperatures for extended time periods on the order of up to four hours or so while still maintaining the freshness and product consistency desired for a product of this type. The merchandising container is a generally rigid one-piece container constructed from synthetic plastic that is preferably transparent and that will withstand storage at elevated temperatures without damage or deterioration. The merchandising container has a generally clamshell type of structure including a tray portion and a cover portion which combine to enclose a food product such as a hotdog and bun sandwich or the like. The tray portion and cover portion are integrally joined by a living hinge member, preferably one that is especially wide and flexible in order to minimize the chance of inadvertent container closure. A locking structure is provided generally opposite to the hinge, and the tray portion and cover portion have substantially complementary generally vertical engagement surfaces on their respective perimeters in order to provide an interference fit. Preferably, the base of the tray has a series of generally concentric formed ridges to inhibit sticking of the food product to the base.

It is accordingly a general object of the present invention to provide an improved rigid one-piece merchandising container.

Another object of the present invention is to provide an improved merchandising container that provides superior storage for extended time periods of heated ready-to-eat food products such as hot sandwiches and the like.

Another object of this invention is to provide an improved merchandising container having a locking system that allows the filled container to be held from its top portion without having the container fall open and expose or drop the food product.

Another object of this invention is to provide an improved one-piece merchandising container having interference fit characteristics to provide a closed system that allows bread products and the like to remain soft and moist when stored within a forced air type of warming oven or other warming oven for at least four hours.

Another object of this invention is to provide an improved rigid one-piece merchandising container that has a gravity-sensitive lock structure to prevent inadvertent opening of the package when the top portion only thereof is grasped.

In accordance with a further object, the rigid package has a flange around its outer edge which allows the package to be suspended by the flange in a specially designed rack, thereby providing a unique combination of package and merchandising rack requiring a package that is similarly sized and that has a similar flange.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
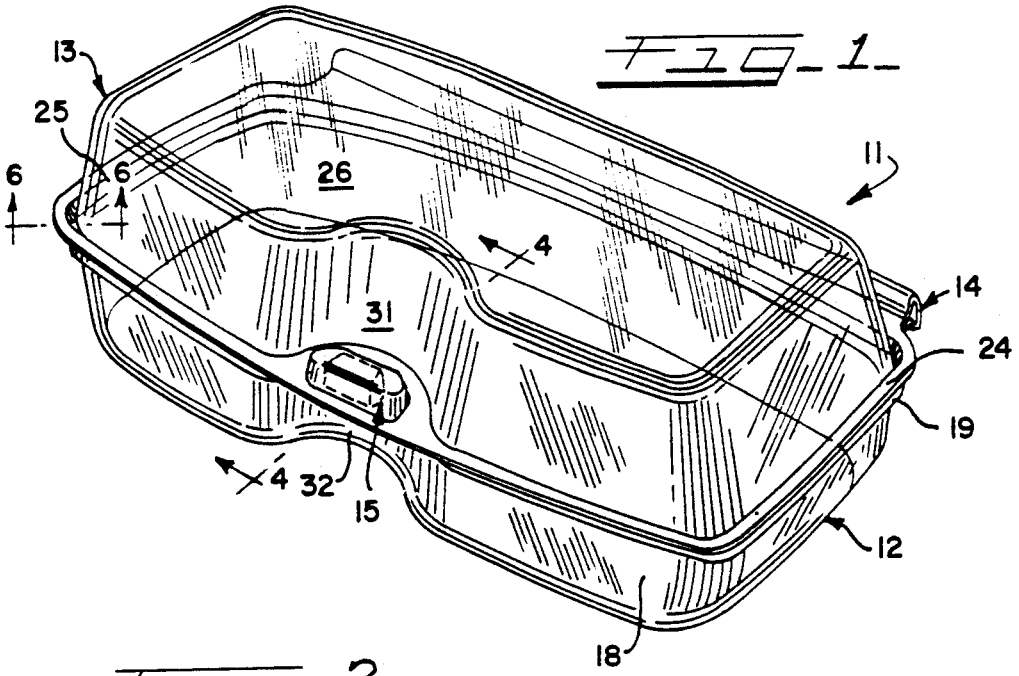
FIG. 1 is a perspective view of a preferred one-piece merchandising container according to the present invention.

A one-piece merchandising container according to the present invention, generally designated as 11 in FIG. 1, includes a tray portion, generally designated as 12, and a cover portion, generally designated as 13. Tray portion 12 and cover portion 13 are joined together by a living hinge portion, generally designated as 14, and a lock assembly, generally designated as 15, is positioned at a location which generally opposes the living hinge portion 14. A food product (not shown) such as a sandwich including a hotdog within a bun or the like will conveniently fit between the tray portion 12 and the cover portion 13 when the lock assembly 15 is closed, as illustrated in FIG. 1. In the typical arrangement, the food product will generally fill the closed marketing container 11.

Tray portion 12 includes a bottom section 16. It is preferred that the bottom section 16 include a plurality of ridges 17 which present a raised surface of minimal cross-section. Ridges 17 raise the food product when it is stored in the container 11 so that same does not simply rest on the bottom surface of section 16, this feature being especially advantageous in preventing product sticking and sogginess of bread components of the food product which would otherwise rest upon the comparatively large surface area of the bottom section 16.

Figure 3:
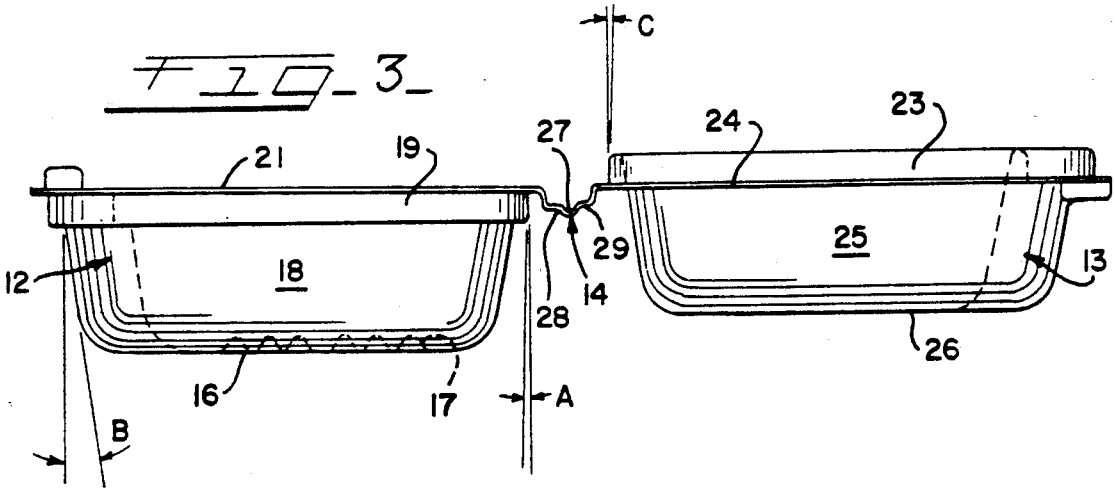
FIG. 3 is an elevational view of the opened container shown in FIG. 2.

A generally upstanding sidewall 18 further defines the tray portion 12. Sidewall 18 includes a peripheral lip portion 19 that preferably terminates in a peripheral flange 21. An intermediate flange 22, which is generally parallel to the peripheral lip portion 19, can be positioned between the generally upstanding sidewall 18 and the peripheral lip portion 19. Preferably, the draft angle "A" (FIG. 3) of the peripheral lip portion 19 is a nominal 0°, which typically correlates to an actual draft angle of approximately 1°. Usually the draft angle "B" of the generally upstanding sidewall 18 is somewhat larger, typically on the order of roughly 5° to 20°, depending upon the shape of the tray portion 12. Whatever the actual configuration of the generally upstanding sidewall 18, it is important that the draft angle "A" be substantially the same as the draft angle "C" of peripheral lip portion 23 of the cover portion 13. This provides the interference fit that is important in providing the closed system characteristics of the merchandising container 11 which permits the products therewithin to remain fresh, such as allowing bread products to remain soft and moist, while the filled merchandising container remains within a forced air type of warming oven or other type of warming oven for at least four hours.

These closed system characteristics are preferably further enhanced by a peripheral flange 24 along the entire free periphery of the peripheral lip portion 23 such that the peripheral flange 24 of the cover portion 13 is in general engagement with the peripheral flange 21 of the tray portion 12. A sidewall 25 of the cover portion 13 joins a top section 26 thereof to the peripheral lip portion 23. As illustrated, it is preferred that this sidewall 25 extends generally behind the peripheral lip portion 23, which is formed as a folded-over or cuffed portion of the sidewall 25. As is the case for sidewall 18 of the tray portion 12, the sidewall 25 of the cover portion 13 will typically have a draft angle substantially larger than draft angle "C" of the peripheral lip portion 23.

Figure 2:
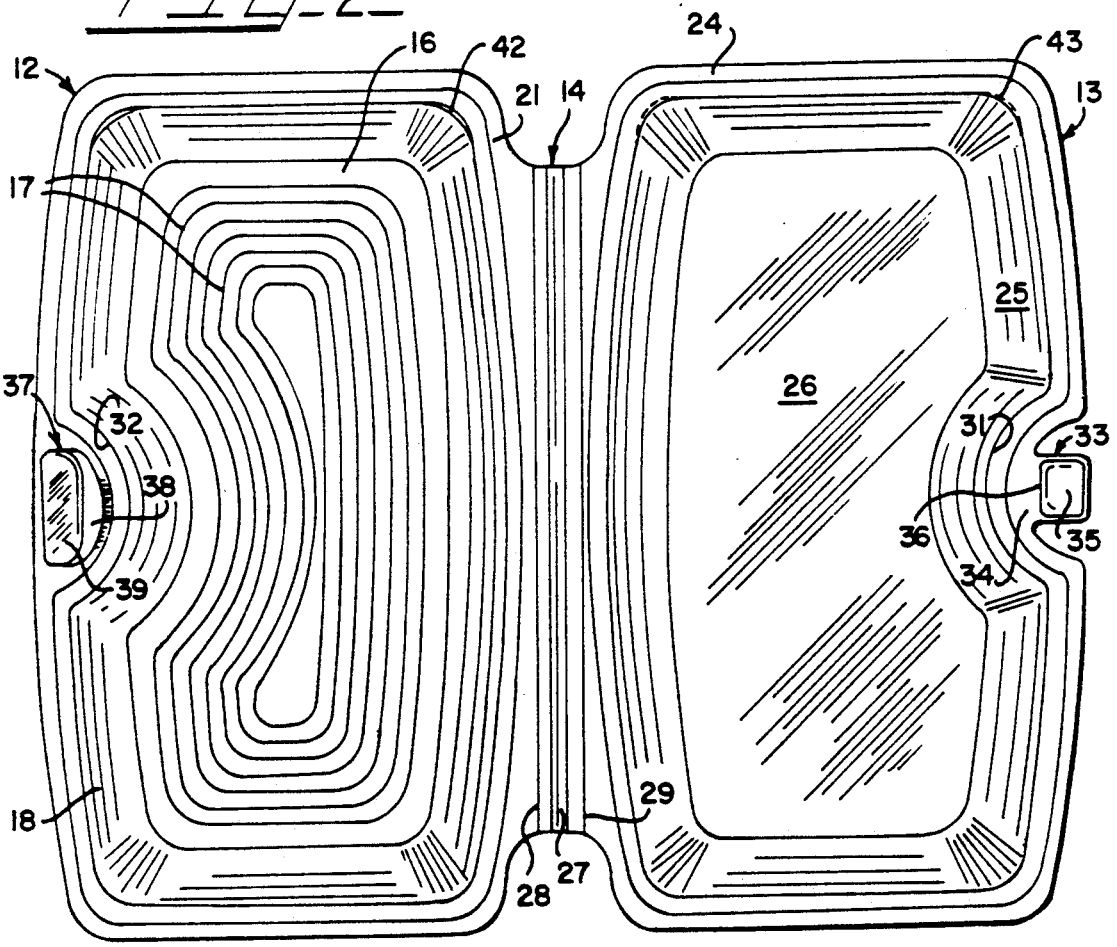
FIG. 2 is a plan view of the merchandising container of FIG. 1, shown in an opened orientation.

In the illustrated embodiment, the peripheral flange 21 and the peripheral flange 24 are joined together by the living hinge portion 14, as perhaps best seen in FIG. 2. The illustrated living hinge portion 14 has an especially wide profile and preferably includes at least one longitudinal section in which the film thickness is thinner than the rest of the merchandising container 11, for example thinner than the peripheral flanges 21 and 24. In an especially preferred arrangement, the living hinge portion 14 includes a thinned longitudinal section 27 including longitudinal creases 28 and 29. With this type of structure, when the merchandising container 11 is opened so that the cover portion 13 is swung off of and away from the tray portion 12, the opened orientation such as that generally illustrated in FIG. 2 and FIG. 3 will be maintained without any substantial tendency of the cover portion 13 to spring back onto the top of the tray portion 12. Without proceeding with such a flattening operation, the memory of the material will tend to change on extended-time warming to a condition which favors springing closed more so than the condition prior to heating.

Interference fit characteristics described above which are provided by the tray portion 12 and the cover portion 13 typically are not sufficient to insure the package will not fall open during transport thereof, which function is usually provided by the lock assembly 15.

The preferred lock assembly 15 is generally located within and between an indentation 31 of the cover portion sidewall 25 and an indentation 32 of tray portion sidewall 18. A protruding part, generally designated as 33, is located substantially within the indentation 31 and is typically supported in generally cantilevered fashion from an indented portion 34 of the cover portion peripheral flange 24. Protruding part 33 includes a raised engagement member or boss 35 having at least one engagement edge 36.

Figure 4:
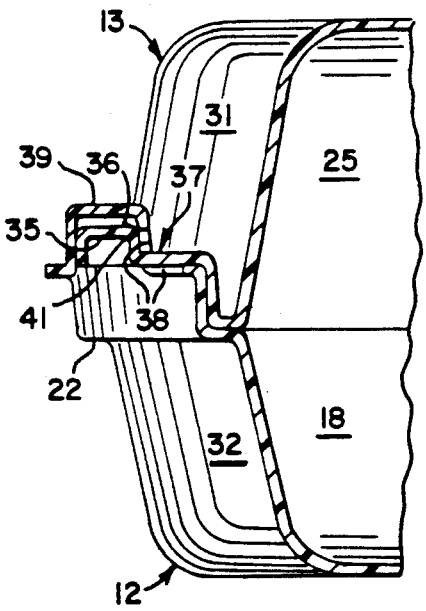
FIG. 4 is a cross-sectional view along the line 4—4 of FIG. 1 at an end portion of the illustrated container, showing a preferred lock assembly in its closed state.
Figure 5:
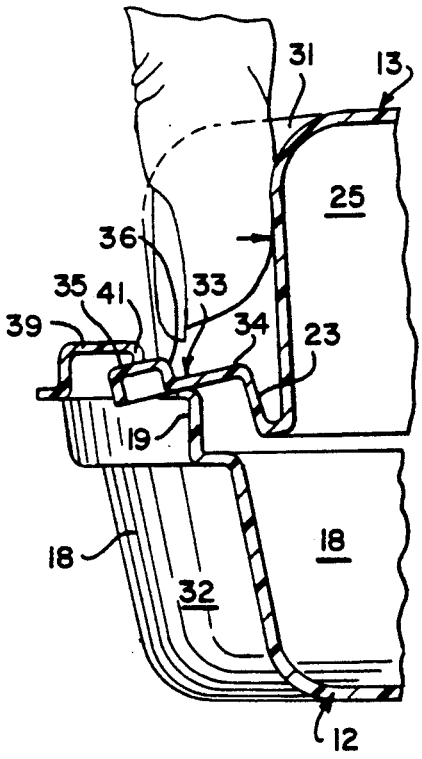
FIG. 5 is a cross-sectional view of the package as illustrated in FIG. 4 and showing the lock assembly in the course of being opened.

Lock assembly 15 further includes a receptor part, generally designated as 37, positioned substantially within the indentation 32 and generally extending along the tray portion peripheral flange 21. Receptor part 37 includes a slot 38 which is large enough to permit passage therethrough of the cover portion protruding part 33, such passage being accomplished by digital forces that are intentionally and somewhat precisely directed onto the indentation 31, as generally illustrated in FIG. 5. Receptor part 37 further includes a raised concave member or dimple 39 having a stop edge 41. By this structure, the cover portion boss 35 mates within the dimple 39 when the merchandising container 11 is fully closed, as illustrated in FIG. 4.

A locking feature is thus provided. In this fully closed orientation, the engagement edge 36 of the boss 35 is slightly in contact with the bottom of the stop edge 41 of the dimple 39 in order to provide a gravity-sensitive condition to the lock assembly 15. More specifically, by this structure, the merchandising container 11 will not inadvertently open when the container 11 is picked up in a manner so as to be supported only by the cover portion 13, even when accompanied by jostling or shaking thereof by the customer, and even when the merchandising container 11 is filled with a typical food product, which will generally weigh on the order of 8 ounces or more. Until the specific opening manipulation procedure illustrated in FIG. 5 is initiated, the merchandising container will remain closed. This condition is maintained whether the package is at room temperature or at elevated temperatures suitable for consumption.

The lock assembly 15 that is illustrated and described herein is especially advantageous in that it requires only minimal additional plastic film material in order to form same during a typical molding operation. It is noted that both the protruding part 33 and the receptor part 37 lie substantially within the respective areas bounded by the flange 24 and indentation 31 and by the flange 21 and the indentation 32.

Figure 6:
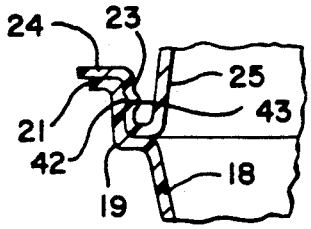
FIG. 6 is a cross-sectional view along the line 6—6 of FIG. 1.

In addition, corner snap locking profiles can be included to complete closure with proper seating of the package components. Corner locking profiles can be seen in FIGS. 2 and 6. A projection 42 is shown in peripheral lip portion 19 of tray portion 12, and a mating indent 43 is shown in peripheral lip portion of cover portion 13.

The merchandising container 11 is made of a synthetic plastic material or film that will not be damaged, deformed, discolored or degraded in appearance when it is used within a warming oven of a type suitable for self-serve food stores. A typical holding oven in this regard is a forced convection oven having an exhaust vent, and a typical merchandising container 11 according to the present invention will maintain its initial shape and appearance when being stored within such an oven at approximately 180° F. for at least four hours. It is also preferred that the material or film be substantially transparent in order to provide the customer with the ability to easily inspect the food product within the merchandising container 11 without any need for attempting to open the merchandising container. Exemplary synthetic plastic materials or films which exhibit all of these products are various transparent polypropylene films.

It will thus be seen that the present invention provides a new and useful merchandising container, which merchandising container has a number of advantages and characteristics, including those pointed out herein and others which are inherent in the invention. Preferred embodiments of the invention have been described by way of example, and it is anticipated that modifications may be made to the described form without departing from the spirit of the invention or the scope of the appended claims.

I claim:

1. A generally rigid one-piece synthetic plastic merchandising container for storing ready-to-eat food products at elevated consumption temperatures, the merchandising container comprising:

a tray portion having a bottom section and a generally upstanding sidewall, said generally upstanding sidewall having a peripheral lip having a designated draft angle, said tray portion further including an intermediate flange between said tray portion sidewall and said tray portion peripheral lip;

a cover portion having a top section, a generally upstanding sidewall and a peripheral lip having a draft angle substantially the same as the designated draft angle of the tray portion peripheral lip, said cover portion further including a generally U-shaped surface which joins and is defined by said cover portion generally upstanding sidewall and said cover portion peripheral lip, said cover portion generally upstanding sidewall being spaced from said cover portion peripheral lip in a direction toward the inside of the container;

said intermediate flange of the tray portion engages said generally U-shaped surface of the cover portion when the merchandising container is in its closed orientation, said tray portion peripheral lip and said cover portion peripheral lip being substantially complementary in size and shape, whereby an interference fit is provided between said tray portion and said cover portion by said respective peripheral lips and by said intermediate flange and generally U-shaped surface;

said tray portion and said cover portion are sized and shaped for enclosing therewithin a ready-to-eat heated food product;

a hinge portion integrally joining said tray portion and said cover portion into said one-piece merchandising container, said tray portion, cover portion and hinge portion being made of a synthetic plastic material capable of withstanding damage upon being subjected to elevated food consumption temperatures for up to four hours and more;

means for locking said tray portion and said cover portion together at a location generally opposite to said hinge portion, said locking means includes a protruding part and a receptor part, said receptor part having a raised concave dimple and a slot positioned with respect to said raised concave dimple in a direction toward the inside of the container, said raised concave dimple further having a stop edge wall generally between and defined by said slot and the deepest portion of said raised concave dimple, said protruding part having a raised engagement boss with a generally upstanding engagement edge, said stop edge wall and said generally upstanding engagement edge being generally parallel to each other; and said protruding part and said receptor part are sized and shaped whereby the protruding part passes through said slot of the receptor part and whereby the generally upstanding engagement edge of the protruding part engages the stop edge wall of the receptor part when the locking means is in its locked orientation.

2. The merchandising container according to claim 1, wherein said raised engagement boss closely mates within said raised concave dimple when said locking means is fully closed.

3. The merchandising container according to claim 1, wherein said designated draft angle is a draft angle having a nominal value of approximately 0°.

4. The merchandising container according to claim 1, further including a peripheral flange at a free edge of said tray portion peripheral lip, a peripheral flange at a free edge of said cover portion peripheral lip, and said respective peripheral flanges are in general engagement with each other when the merchandising container is in its closed orientation.

5. The merchandising container according to claim 4, wherein said hinge portion is an extension of said respective peripheral flanges, whereby said hinge portion joins said flanges together.

6. The merchandising container according to claim 1, wherein said hinge portion includes a longitudinal section having a thickness which is thinner than the remainder of said hinge portion.

7. The merchandising container according to claim 1, wherein said hinge portion includes a longitudinal crease defining a length of thinned synthetic plastic which extends for the full length of the hinge portion.

8. The merchandising container according to claim 1, wherein said tray portion peripheral lip and said cover portion peripheral lip have engagement surfaces with a substantially vertically extending orientation.

9. The merchandising container according to claim 8, further including a substantially horizontal peripheral flange at a free edge of each of said substantially vertically extending peripheral lips, and said respective horizontal peripheral flanges engage each other when the merchandising container is in its closed orientation.

10. The merchandising container according to claim 1, further including upstanding ridges in said tray portion bottom section.

11. The merchandising container according to claim 1, wherein the merchandising container is a molded piece of substantially transparent sheet.

12. The merchandising container according to claim 1, further including at least one snap locking profile structure having a profile component along said tray portion peripheral lip and a complementary profile component along said cover portion peripheral lip.

13. The merchandising container according to claim 12, wherein said snap locking profile structure is located in at least one corner of said respective peripheral lips.

14. The merchandising container according to claim 1, further including an indented portion of the generally upstanding sidewall and the peripheral lip of the tray portion and an indented portion of the generally upstanding sidewall and the peripheral lip of the cover portion, and said locking means is positioned at said indented portions and is partially defined by said indented portions of the peripheral lips.

15. A generally rigid one-piece synthetic plastic merchandising container for storing ready-to-eat food products at elevated consumption temperatures, the merchandising container comprising a single piece of substantially transparent sheet capable of withstanding damage upon being subjected to elevated food consumption temperatures and molded into:

a tray portion having a bottom section and a generally upstanding sidewall, said bottom section including upstanding ridges, and said generally upstanding sidewall having a peripheral lip having a draft angle of a nominal 0° value, said tray portion further including an intermediate flange between said tray portion sidewall and said tray portion peripheral lip;

a cover portion having a top section, a generally upstanding sidewall and a peripheral lip having a draft angle of a nominal 0° value, said cover portion further including a generally U-shaped surface which joins and is defined by said cover portion generally upstanding sidewall and said cover portion peripheral lip, said cover portion generally upstanding sidewall being spaced from said cover portion peripheral lip in a direction toward the inside of the container;

said intermediate flange of the tray portion engages said generally U-shaped surface of the cover portion when the merchandising container is in its closed orientation, said tray portion peripheral lip and said cover portion peripheral lip being substantially complementary in size and shape, whereby an interference fit is provided between said tray portions and said cover portion by said respective peripheral lips and by said intermediate flange and generally U-shaped surface;

said tray portion and said cover portion are sized and shaped for enclosing therewithin a ready-to-eat heated food product;

a hinge portion integrally joining said tray portion and said cover portion into said one-piece merchandising container, having a generally clamshell structure;

means for locking said tray portion and said cover portion together at a location generally opposite to said hinge portion, said locking means including a protruding part and a receptor part, said protruding part having a generally upstanding raised engagement boss, said receptor part having a raised concave dimple for receiving said raised engagement boss in a locking orientation, said raised concave dimple having a stop edge wall, and said receptor part further including slot means for permitting movement of said raised engagement boss therethrough, said slot means being defined in part by said stop edge wall; and said protruding part and said receptor part are sized and shaped whereby the protruding part passes through said slot of the receptor part and whereby the generally upstanding engagement boss of the protruding part engages the stop edge wall of the receptor part when the locking means is in its locked orientation.

16. The merchandising container according to claim 15, wherein said raised engagement boss closely mates within said raised concave dimple when said locking means is fully closed.

17. The merchandising container according to claim 15, wherein said tray portion peripheral lip and said cover portion peripheral lip each have a substantially vertically extending orientation, a substantially horizontal peripheral flange is provided at a free edge of each of said substantially vertically extending peripheral lips, and said respective horizontal peripheral flanges engage each other when the merchandising container is in its closed orientation.

18. The merchandising container according to claim 15, further including an indented portion of the generally upstanding sidewall and the peripheral lip of the tray portion and an indented portion of the generally upstanding sidewall and the peripheral lip of the cover portion, and said locking means is positioned at said indented portions and is partially defined by said indented portions of the peripheral lips.

* * * * *